US009550385B2

(12) United States Patent
Furuya et al.

(10) Patent No.: US 9,550,385 B2
(45) Date of Patent: Jan. 24, 2017

(54) IMAGE FORMING DEVICE AND NON-TRANSITORY COMPUTER READABLE MEDIUM

(71) Applicant: FUJI XEROX CO., LTD., Tokyo (JP)

(72) Inventors: Masami Furuya, Kanagawa (JP); Takeshi Zengo, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/835,813

(22) Filed: Aug. 26, 2015

(65) Prior Publication Data

US 2016/0214421 A1 Jul. 28, 2016

(30) Foreign Application Priority Data

Jan. 26, 2015 (JP) ..... 2015-012400

(51) Int. Cl.
*B41J 29/393* (2006.01)
*B41J 2/165* (2006.01)
*B41J 29/38* (2006.01)

(52) U.S. Cl.
CPC ..... *B41J 29/38* (2013.01)

(58) Field of Classification Search
CPC .... B41J 2/165; B41J 29/393; B41J 2029/3937
See application file for complete search history.

(56) References Cited

U.S. PATENT DOCUMENTS

2012/0162721 A1 6/2012 Shimizu

FOREIGN PATENT DOCUMENTS

JP 2006-240141 9/2006
JP 2012-139901 7/2012

OTHER PUBLICATIONS

Abstract and machine translation of JP 2006-240141.
Abstract and machine translation of JP 2012-139901.

*Primary Examiner* — Jason Uhlenhake
(74) *Attorney, Agent, or Firm* — Fildes & Outland, P.C.

(57) ABSTRACT

In the case where, by driving nozzles, test images are formed on paper so that the area of a width predetermined from an end portion in an intersecting direction that intersects with a transporting direction of the paper of a reading area of image reading units is not included in the test images, and the nozzles in an abnormal state are detected by using reading data obtained by reading by the image reading units, the application scope of the reading data applied for detection of an abnormal state is determined so that reading data of each of the test images formed by the nozzles as a detection target of an abnormal state is not repeatedly included with regard to each nozzle, and the nozzles in an abnormal state are detected by using the reading data in the determined application scope.

12 Claims, 12 Drawing Sheets

IMAGE FORMING DEVICE AND NON-TRANSITORY COMPUTER READABLE MEDIUM

CROSS-REFERENCE TO RELATED APPLICATIONS

This application is based on and claims priority under 35 USC 119 from Japanese Patent Application No. 2015-012400 filed on Jan. 26, 2015.

BACKGROUND

Technical Field

The present invention relates to an image forming device and a non-transitory computer readable medium.

SUMMARY

An aspect of the present invention provides an image forming device, comprising: plural recording elements that are arranged along an intersecting direction that intersects with a transporting direction of a recording medium; plural reading units each including a reading area which extends in the intersecting direction, and that read plural test images formed by driving the recording elements using the reading areas, and that are provided along the intersecting direction so that adjacent end portions of the reading areas overlap in the transporting direction, which defines as an overlapping reading area; a forming unit forms the plural test images by driving the recording elements as a detection target in an abnormal state, in which a position of each test image is predetermined in accordance with a standard position, as a position matching of the recording medium in the intersecting direction, the position of each test image corresponds to the reading area on the recording medium, and each test image is formed so that an area having a width predetermined from an end portion of the corresponding reading area in the intersecting direction is not included; a determining unit that in case of detecting the recording elements in the abnormal state by using reading data obtained by each reading unit, determines an application scope of the reading data applied for detecting the abnormal state so that the reading data of each test image formed by the recording elements as the detection target does not include repeatedly data with respect to each recording element; and a detecting unit that detects the recording elements in the abnormal state by using reading data in the application scope determined by the determining unit.

BRIEF DESCRIPTION OF THE DRAWINGS

Exemplary embodiments of the present invention will be described in detail based on the following figures, wherein.

DETAILED DESCRIPTION

Hereinafter, exemplary embodiments for implementing the present invention will be described with reference to the drawings.

(First Embodiment)

A first embodiment will be described by referring to the case where the invention is applied to the ink jet recording device that records an image by discharging an ink drop on a recording medium.

First, with reference to FIGS. 1 to 3, the configuration of an ink jet recording device 10 related to this embodiment will be described.

Figure 1:
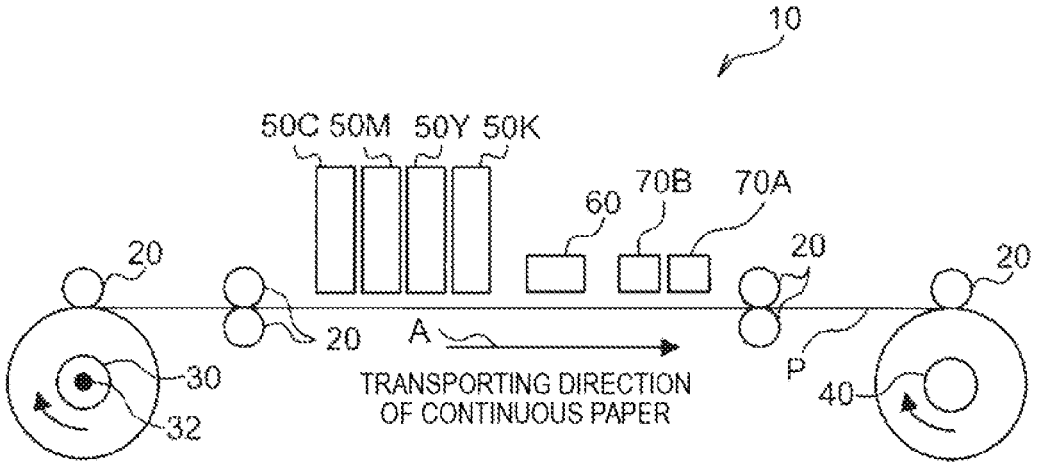
FIG. 1 is a schematic side view that illustrates the major configuration of the ink jet recording device related to each embodiment.

As illustrated in FIG. 1 the ink jet recording device 10 related to this embodiment includes a transporting roller 20, a paper feeding roll 30, a rotary encoder 32, a discharging roll 40, recording heads 50C, 50M, 50Y, and 50K, a drying unit 60, and image reading units 70A and 70B.

The transporting roller 20 related to this embodiment rotates by a transporting motor 22 (refer to FIG. 4) coupled with the transporting roller 20 through mechanisms such as a gear being driven. In addition, at the paper feeding roll 30 related to this embodiment, a long continuous paper P is wound as a recording medium, and the continuous paper P is transported in the direction of an arrow A in FIG. 1 in association with the rotation of the transporting roller 20. Moreover, the transported continuous paper P is wound at the discharging roll 40. Furthermore, hereinafter, the direction in which the continuous paper P is transported (the direction of the arrow A in FIG. 1) is simply referred to as "transporting direction".

The rotary encoder 32 related to this embodiment is provided in the rotation axis of the paper feeding roll 30 and outputs a clock signal for every time the paper feeding roil 30 is rotated at a predetermined angle.

The recording heads 50C, 50M, 50Y, and 50K related to this embodiment are provided in this order along the transporting direction from upstream of the transporting direction. In addition, hereinafter, in the case where there is no need to distinguish between the recording heads 50C, 50M, 50Y, and 50K, the alphabetical character at the end of the symbol is omitted.

Figure 2:
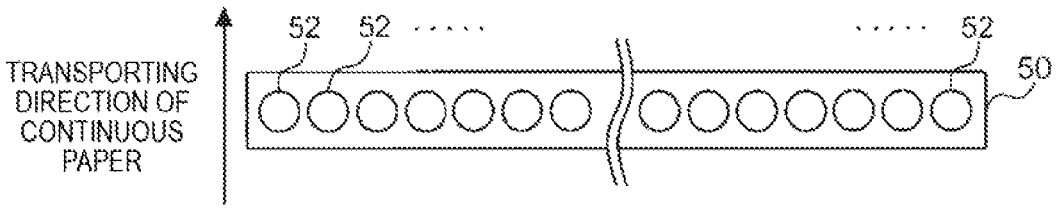
FIG. 2 is a schematic bottom view that illustrates the schematic configuration of the recording head related to each embodiment.

Moreover, as illustrated in FIG. 2, the recording heads 50 include plural nozzles 52 arranged along the intersecting direction that intersects with the transporting direction (hereinafter, simply referred to as "intersecting direction"). In addition, the plural nozzles 52 are one example of a recording element of the present invention. Furthermore, the recording heads 50C, 50M, 50Y, and 50K discharge ink drops corresponding to each of the four colors of cyan (C), magenta (M), yellow (Y), and black (K) from the nozzles 52 on the continuous paper P. In addition, in the ink jet recording device 10 related to this embodiment, in order to identify each of the nozzles 52, a nozzle number in the order of 1, 2, . . . is attached to each nozzle 52 from 1.

The drying unit 60 related to this embodiment, for example, includes plural surface emission laser elements, dries the ink drop by applying laser from the surface emission laser elements to the ink drop discharged onto the continuous paper P to fix the ink drop to the continuous paper P. In addition, as the drying unit 60, other devices such as a heater that dries an ink drop discharged onto the continuous paper P by warm air may be applied.

Plural (two in this embodiment) image reading units 70A and 70B related to this embodiment are provided from the upstream of the transporting direction in the order of the image reading unit 70A and the image reading unit 706. In addition, hereinafter, in the case where there is no need to distinguish between the image reading units 70A and 70B, the alphabetical character at the end of the symbol is omitted. Moreover, as illustrated in FIG. 3, the image reading units 70 related to this embodiment are provided in the state where each one end portion is protruded in the intersecting direction only by width W from the end portion in the intersecting direction (side edge) of the continuous paper P. The continuous paper P in FIG. 3 is a case illustrated where a continuous paper in the maximum size in this device is loaded In the case where a continuous paper smaller than this size is loaded, the protrusion width at the other end portion side of the registration position is (the maximum continuous paper size−loaded continuous paper size+W1), In addition, the image reading units 70 are provided along the intersecting directions so that the area of the end portions of adjacent reading areas are overlapped in the transporting direction. Moreover, hereinafter, the scope of the end portions of the reading areas in the intersecting direction overlapped in the transporting direction is referred to as a "reading overlapping scope".

Specifically, the image reading units 70 are provided so that the width of the reading overlapping scope is width W2, and the center part of the width W2 coincides with the center part of the continuous paper P in the intersecting direction. In addition, in FIG. 3, the width from the both end portions (dashed line illustrated in FIG. 3) of an image forming area G of the continuous paper P in the intersecting direction to the center part of the continuous paper P in the intersecting direction of is respectively illustrated as width W3. Moreover, in this embodiment, as an example, the width W1 is 21 mm, the width W2 is 52 mm, and the width W3 is 250 mm. Furthermore, in the ink jet recording device 10 related to this embodiment, the width of the image forming area G in the intersecting direction illustrated in FIG. 3 is the maximum width of an image formed by the recording head 50 in the intersecting direction.

In addition, the image reading unit 70 related to this embodiment is set as a line sensor including, for example, a charged coupled device (CCD), a lens, or the like, and reads the image formed on the continuous paper P along the transporting direction at the predetermined resolution for each line extending in the intersecting direction. Moreover, the image reading unit 70 outputs brightness information indicating the light intensity of each pixel corresponding to the concentration of the read image as reading data. In addition, in the image reading unit 70, there is a case where the resolution of the reading is deteriorated as the image reading unit 70 comes close to the periphery of a lens by an influence of a deformation at the periphery of the lens according to the quality of the lens to be used. Here, the image reading unit 70 related to this embodiment is arranged as illustrated in FIG. 3 in order to read the image formed on the continuous paper P at the area as near as possible to the center part of the image reading unit 70 in the intersecting direction.

Figure 3:
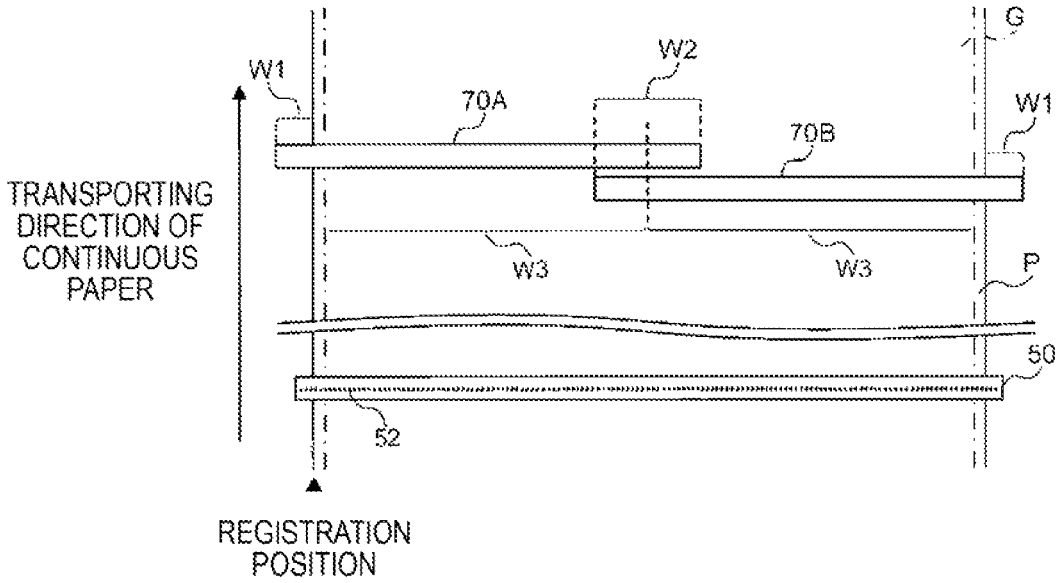
FIG. 3 is a schematic plan view used for describing the arrangement state of the image reading unit related to each embodiment.

In addition, as illustrated in FIG. 3, in the ink jet recording device 10 related to this embodiment, a standard position (hereinafter referred to as "registration position") for aligning the position of the continuous paper P in the intersecting direction is set as one end portion (in the example illustrated in FIG. 3, the left end portion) of the continuous paper in the intersecting direction. Moreover, hereinafter, as in this embodiment, the registration position being the one end portion of the continuous paper P in the intersecting direction is referred to as "side registration", Next, with reference to FIG. 4, the configuration of the major parts of the electric system of the ink jet recording device 10 related to this embodiment will be described.

Figure 4:
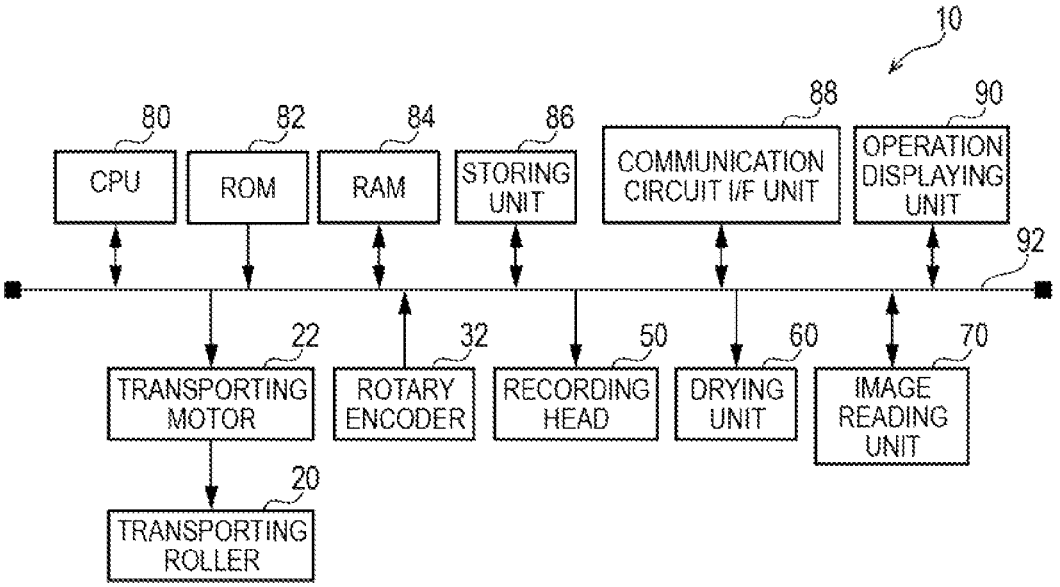
FIG. 4 is a block diagram that illustrates the major configuration of the electric system of the ink jet recording device related to each embodiment.

As illustrated in FIG. 4, the ink jet recording device 10 related to this embodiment includes a central processing unit (CPU) 80 that directs entire operations of the ink jet recording device 10, and a read only memory (ROM) 82 in which various programs and parameters and the like are stored in advance. In addition, the ink jet recording device 10 also includes a random access memory (RAM) 84 used as a work area and the like when various programs are executed by the CPU 80, and a non-volatile recording unit 86 such as a flash memory.

Moreover, the ink jet recording device 10 includes a communication circuit interface (I/F) unit 88 that performs transmission and reception of communication data with an external device, Furthermore, the ink jet recording device 10 includes an operation displaying unit 90 that receives an instruction from the user with regard to the ink jet recording device 10 and notifies regarding various pieces of information related to the operation status and the like of the ink jet recording device 10 to the user. In addition, the operation displaying unit 90 includes, for example, a display of a touch panel type which displays a display button and various pieces of information that realize the reception of an operation instruction by executing a program, and a hardware key such as a numeric key or a start button.

In addition, each of the CPU 80, the ROM 82, the RAM 84, the storing unit 86, the transporting motor 22, the rotary encoder 32, and the recording head 50 is coupled with each other through a bus 92 such as an address bus, a data bus, or a control bus. Moreover, in addition to these, each of the drying unit 60, the image reading unit 70, the communication circuit I/F unit 88, and the operation displaying unit 90 is also coupled with each other through the bus 92. Furthermore, in the transporting motor 22, the transporting roller 20 is coupled.

According to the above configuration, the ink jet recording device 10 related to this embodiment respectively accesses the ROM 82, the RAM 84, and the storing unit 86, and transmits and receives the communication data through the communication circuit I/F unit 88 by the CPU 80. In addition, the ink jet recording device 10 respectively performs acquisition of various data through the operation displaying unit 90 and display of various pieces of information with regard to the operation displaying unit 90 by the CPU 80. Moreover, the ink jet recording device 10 respectively performs reception of a clock signal output from the rotary encoder 32 and control of the recording head 50, the drying unit 60, and the image reading unit 70 based on the clock signal by the CPU 80. Furthermore, the ink jet recording device 10 respectively performs control of the rotation of the transporting roller 20 through the transporting motor 22 and acquisition of the brightness output from the image reading unit 70 by the CPU 80.

Meanwhile, in the ink jet recording device 10 related to this embodiment, an abnormal nozzle detection function is equipped for detecting a nozzle 52 in an abnormal state (hereinafter simply referred to as "abnormal nozzle"). In addition, the ink jet recording device 10 forms a test image for detecting the abnormal nozzle on the continuous paper P in order to realize the abnormal nozzle detection function. Moreover, for the "abnormal state of the nozzle 52", a non discharging abnormality in which the ink drop is not discharged, a thin line abnormality in which the discharge amount of the ink drop decreases, a deviation abnormality in which the landing position of the ink drop is deviated, and the like can be exemplified. In addition, hereinafter, in order to avoid complication, the case where only the abnormal nozzle of the recording head 50K is detected will be described, but the same applies to the recording heads 50C, 50M, and 50Y corresponding to other colors.

Moreover, in the ink jet recording device 10 related to this embodiment, there is a need for determining the application scope of the reading data of each image reading unit 70 applied to the detection of the abnormal nozzle (hereinafter simply referred to as "application scope"), since the test image is read by plural image reading units 70. Here, in the ink jet recording device 10 related to this embodiment, an application scope determination function for determining the application scope is also equipped.

Next, with reference to FIGS. 5 to 6, the test image of the ink jet recording device 10 related to this embodiment will be described. Meanwhile, hereinafter, the case where the entirety of nozzles 52 are set as the detection target of an abnormal state at the position corresponding to the width of the image forming area G in the intersecting direction determined according to the size of the continuous paper P will be described. In addition, hereinafter, the nozzle 52 which is the detection target is referred to as "detection target nozzle".

Figure 5:
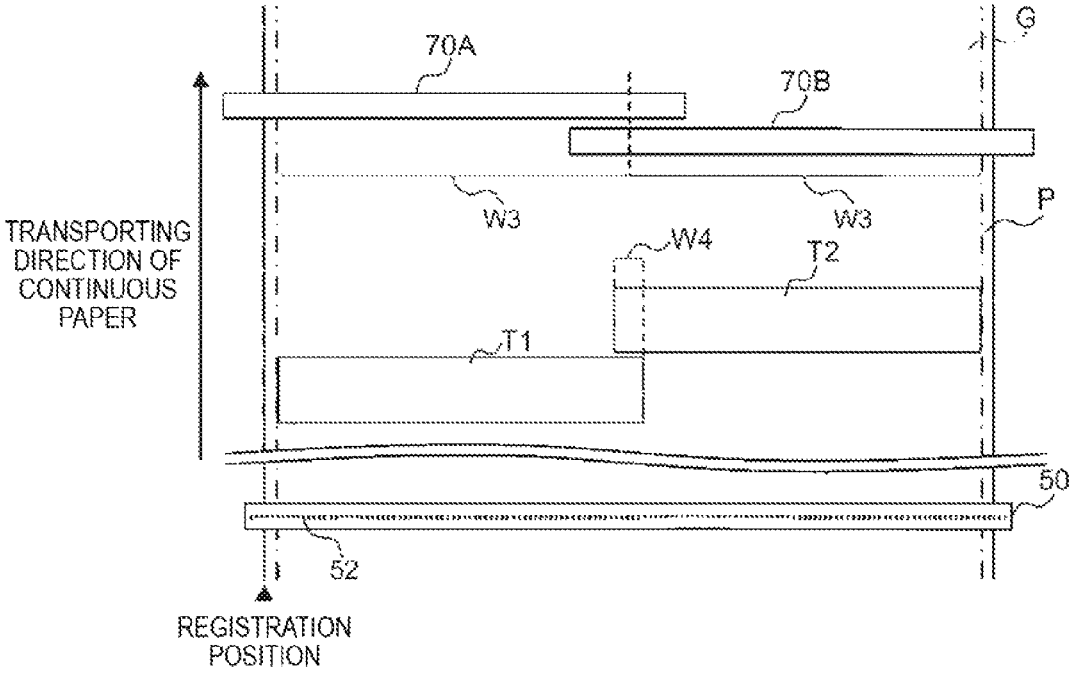
FIG. 5 is a plan view used for describing one example of a test image related to a first embodiment.

First, as illustrated in FIG. 5, the test images T1 and T2 related to this embodiment are formed in the order of the test image T1 to the test image T2 from the upstream of the transporting direction. In addition, the test images T1 and T2 related to this embodiment are set as the images with the same size and shape. Moreover, hereinafter, in the case where there is no need to distinguish between the test images T1 and T2, the alphabetical character at the end of the symbol is omitted. Furthermore, as illustrated in FIG. 5, test images T related to this embodiment are formed so that adjacent end portions are overlapped in the transporting direction inside the reading overlapping scope.

Specifically, in the test images T, the adjacent end portions are overlapped in the transporting direction only by the width W4 in the intersecting direction. In addition, in this embodiment, the width W4 is set as the width shorter than the width W2 of the reading overlapping scope, as the width readable by the image reading unit 70 with the predetermined number of pixels (for example, 5 pixels) or more, and, specifically, as an example, as 10 mm. Therefore, the width of the test images T in the intersecting direction related to this embodiment is respectively 255 mm. In addition, the width W4 being the width readable by the image reading unit 70 with 5 pixels or more is because an approximation (hereinafter described in detail) is performed by a second interpolation. Moreover, the predetermined number of pixels is adaptable as long as the number is set based on the value of the resolution of the image reading unit 70 in the intersecting direction, the value of the width W2, or the like. In addition, the test images T1 and T2 related to this embodiment are formed at the position on the continuous paper P in which the area of the width predetermined from the end portion of the reading area of each of the image reading units 70A and 70B in the intersecting direction is not included. Moreover, the predetermined width may be suitably set based on the amount of the deformation of a lens or the like.

Figure 6:
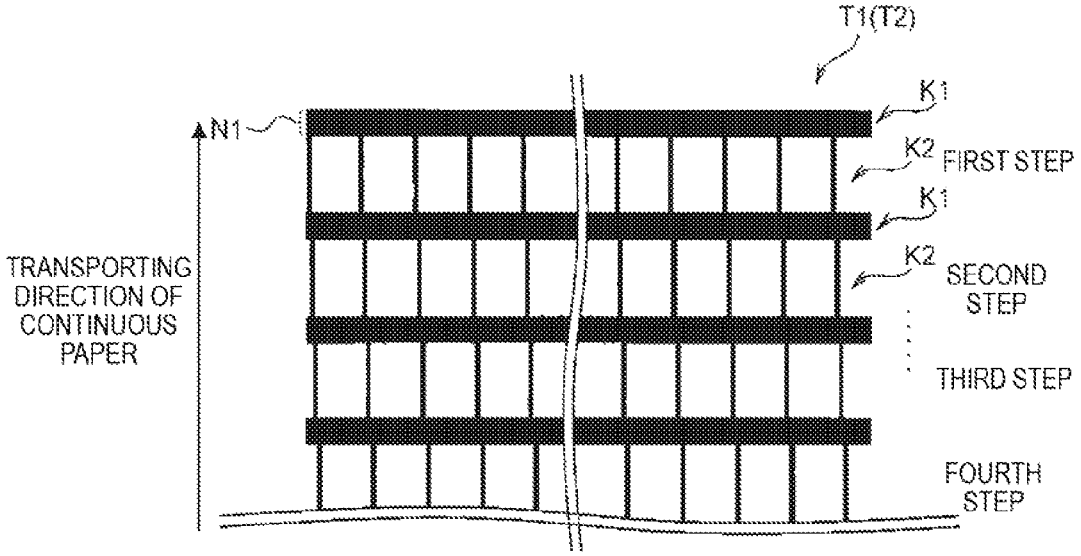
FIG. 6 is a plan view used for describing one example of a standard image and an detection image related to each embodiment.

Next, as illustrated in FIG. 6, the test images T related to this embodiment are images in which plural standard images K1 and detection images K2 of the same number as the standard images K1 are alternately and continuously formed in the transporting direction. The standard image K1 related to this embodiment is an image formed by the ink drop discharged from the entirety of the detection target nozzles. In addition, the length N1 in the transporting direction of the standard image K1 is set as the length read plural times by the image reading unit 70.

The detection images K2 are images formed by dividing the detection target nozzle into plural nozzles 52 groups in which plural nozzles 52 arranged with the space for the nozzles 52 of the predetermined number (in this embodiment, for example, 9) in the intersecting direction is one group, and by causing every nozzle 52 group to discharge the ink drop. In addition, the detection images K2 are formed at the position in which the nozzles 52 in the intersecting direction are deviated for the predetermined number (in this embodiment, for example, 1), while the timing is different for each nozzle 52 groups.

Therefore, the detection images K2 in the first step illustrated in FIG. 6 are images formed by the nozzles 52 of 10n+1st (n=0, 1, 2 . . . ) based on the nozzles 52 at the position corresponding to the left end portion of the test images T in FIG. 6 In addition, similarly, the detection images K2 in the second step illustrated in FIG. 6 are images formed by the nozzles 52 of 10n+2nd (n=0, 1, 2 . . . ) based on the nozzles 52 at the position corresponding to the left end portion. In other words, the standard image K1 and the detection images K2 are alternatively and respectively formed for every amount of 10. In addition, the length of the detection images K2 in the transporting direction is also set as the length read by plural times by the image reading unit 70. Moreover, in this embodiment, the image information indicating the test images T described above (hereinafter referred to as "test image information) is stored in the storing unit 86 in advance.

Figure 7:
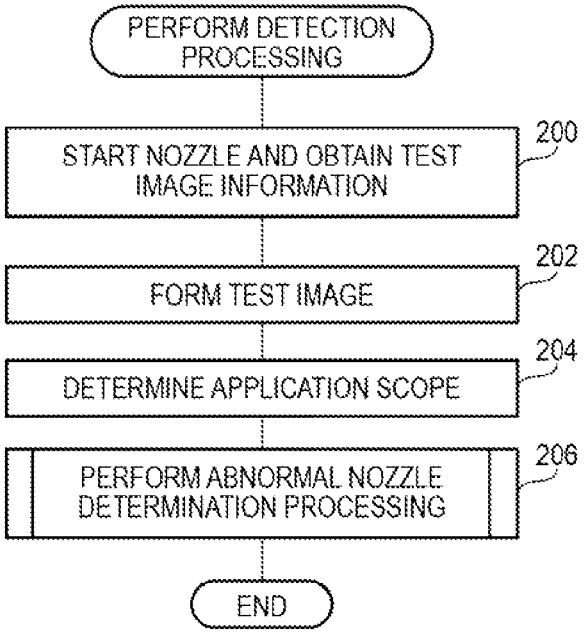
FIG. 7 is a flowchart that illustrates the flow of the processing of the detection processing program related to the first embodiment.

Next, with reference to FIG. 7, the operation of the ink jet recording device 10 related to this embodiment will be described. In addition, FIG. 7 is a flowchart illustrating the flow of the processing of the detection processing program executed by the CPU 80 when an instruction input that instructs regarding the execution start through the operation displaying unit 90 is input by the user. In addition, the detection processing program is installed in the ROM 82 in advance. Moreover, in this embodiment, the timing of inputting the instruction input that instructs the execution start is applied, as the timing of executing the detection processing program, but the timing is not limited thereto. For example, as the timing of executing the detection processing program, other timings such as the timing when images of predetermined page numbers are formed may be applied.

In a step 200 in FIG. 7, the CPU 80 reads test image information from the storing unit 86, and specifies the scope of the number of nozzles that forms the test images T1 and T2 based on the width of the image forming area G in the intersecting direction of the continuous paper P and the width of the test images T1 and T2 in the intersecting direction displayed by the test image information. In a next step 202, the CPU 80 forms the test images T1 and T2 on the continuous paper P by driving part of the recording head 50K, the transporting motor 22, and the like which are related to the transportation of the continuous paper P based on the test image information read by the processing of step 200 and the scope of the specified number of the nozzles.

In a next step 204, the CPU 80 respectively determines the scopes of reading by the image reading units 70A and 70B as the application scopes of the reading data of the test images T1 and T2 by the image reading units 70A and 70B.

The determination processing of the reading scope of the main step 204 will be described in detail with reference to FIGS. 8 and 9.

Figure 8:
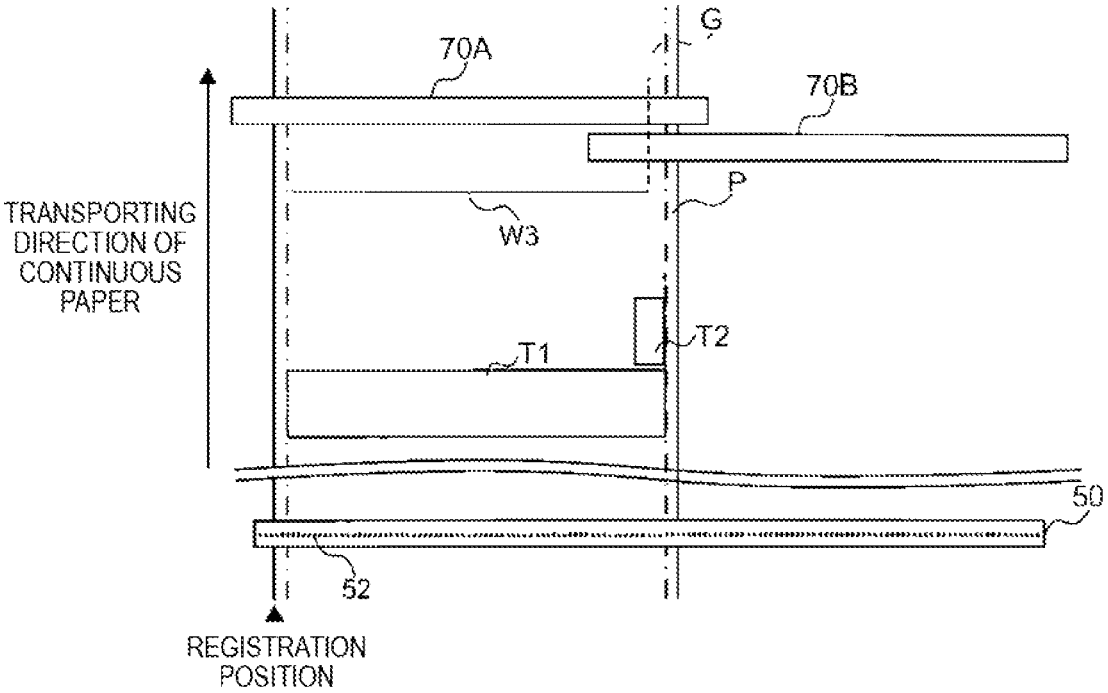
FIG. 8 is a plan view used for describing one example of the determination processing of the reading scope performed by the image reading unit related to the first embodiment.

First, as illustrated in FIG. 8, the CPU 80 determines the scope of the image forming area G in the intersecting direction as the reading scope by the image reading unit 70A in the case where the width of the image forming area G in the intersecting direction is equal to or less than the width of the test images T in the intersecting direction at the registration position side indicated by the test image information (that is, the test image T1). In addition, in this case, the CPU 80 determines that the reading scope by the image reading unit 70B is 0 (zero). Therefore, in this case, the reading of the test image T2 by the image reading unit 70B is not performed. Moreover, the reading of the test image T2 by the image reading unit 70A may not be performed, and the image reading unit 70A may read the test image T2 and may not perform abnormal nozzle determination processing to be described later.

Figure 9:
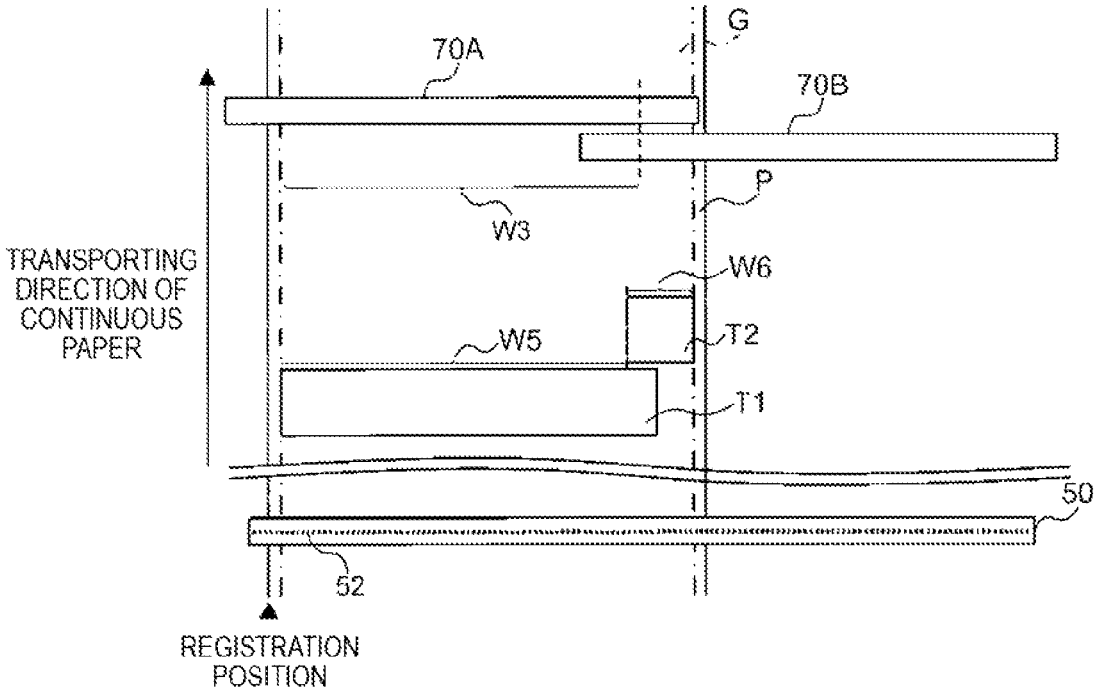
FIG. 9 is a plan view used for describing one example of the determination processing of the reading scope performed by the image reading unit related to the first embodiment.

Next, as illustrated in FIG. 9, the CPU 80 determines the reading scope so that the reading scope of the test image T2 in the intersecting direction by the image reading unit 70B is the maximum in the case where the width of the image forming area G in the intersecting direction is greater than the width of the test images T in the intersecting direction at the registration position side. Specifically, as illustrated in FIG. 9, the CPU 80 determines the width W5 from the end portion at the registration position side of the test image T1 in the intersecting direction to the end portion at the registration position side of the test image T2 as the reading scope by the image reading unit 70A. In addition, in this case, the CPU 80 determines that the width W6 of the test image T2 in the intersecting direction is the reading scope by the image reading unit 70B.

Moreover, hereinafter, in order to avoid complication, the reading by each image reading unit 70 will be described as being performed in the reading scope determined by the processing of the step 204.

In a step 206 of FIG. 7, the CPU 80 executes the abnormal nozzle determination processing routine and program, and terminates a main detection processing program after the abnormal nozzle determination processing routine and program are terminated.

Hereinafter, with reference to FIG. 10, an abnormal nozzle determination processing routine and program related to the embodiment will be described. In addition, FIG. 10 is the flowchart that illustrates the flow of the processing of the abnormal nozzle determination processing routine and program, and the program is also installed in the ROM 82 in advance.

Figure 10:
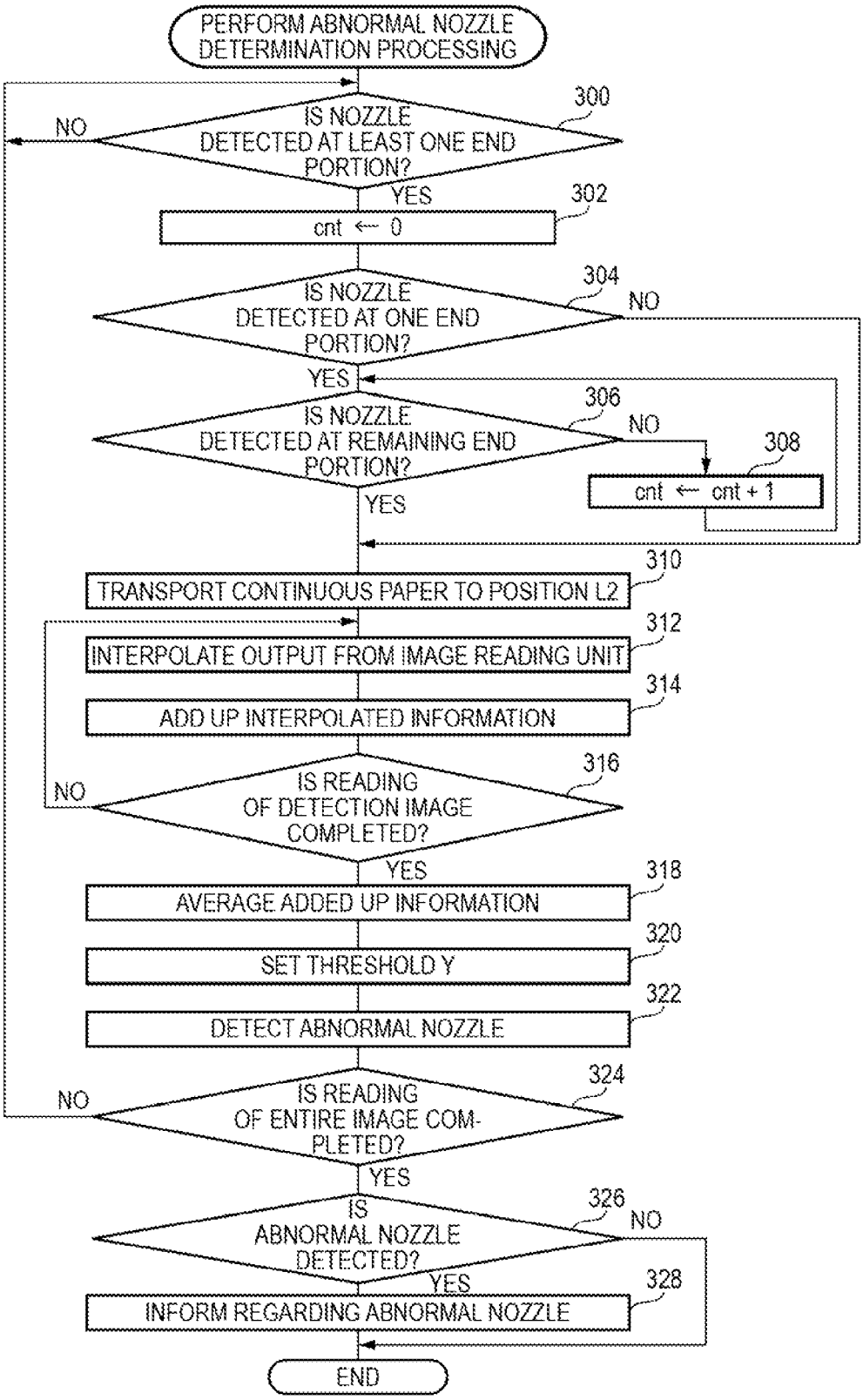
FIG. 10 is a flowchart that illustrates the flow of the processing of the abnormal nozzle determination processing routine and program related to the each embodiment.

In a step 300 of FIG. 10, the CPU 80 performs reading for every line by the image reading unit 70 until at least any end portion of one end portion of the standard image K1 in the intersecting direction by the image reading unit 70 and the other end portion (in this embodiment, a tip end portion in the transporting direction) is read. In the case where the CPU 80 detects that at least any one of the one end portion of the image read by the image reading unit 70 and the other end portion has a black pixel, the step 300 is determined as positive, and the process proceeds to the processing of a step 302.

In the step 302, the CPU 80 substitutes 0 (zero) for a variable cnt, which is to count the difference between the reading timing of one end portion by the image reading unit 70 and that of the other end portion. In a next step 304, the CPU 80 determines whether the black pixel detected in the step 300 is present in only the one end portion in the intersecting direction. The CPU 80 proceeds to the processing of a step 306 in the case where this determination is positive, and proceeds to the processing of a step 310 in the case where the determination is negative.

In the step 306, the CPU 80 performs reading for every line by the image reading unit 70 until the remaining end portion of the standard image K1 in the intersecting direction by the image reading unit 70 (in this embodiment, the tip end portion in the transporting direction) is read. In addition, in a step 308, the CPU 80 performs an increment of the variable cnt one by one for every reading of one line by the image reading unit 70. In the case where the CPU 80 detects that the remaining one end portion of the image read by the image reading unit 70 has a black pixel, the step 306 is determined as positive, and the process proceeds to the processing of the step 310.

Here, with reference to FIGS. 11 to 13, the processing from the step 300 to the step 308 will be described.

Figure 11:
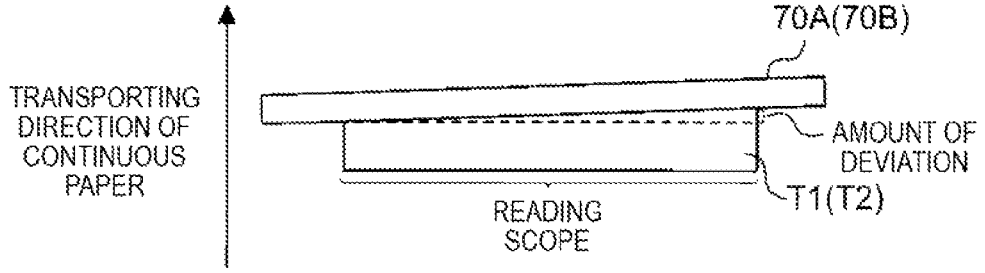
FIG. 11 is a plan view used for describing one example of the inclination between the continuous paper and the image reading unit related to each embodiment.

As illustrated in FIG. 11, in the ink jet recording device 10 related to this embodiment, due to an error in the installing position of the image reading unit 70, the inclinations of the continuous paper P generated when the continuous paper P is transported, or the like, there is a case where the test image T is read by the image reading unit 70 in the state where the image reading unit 70 and the continuous paper P are relatively inclined in the transporting direction.

Figure 12:
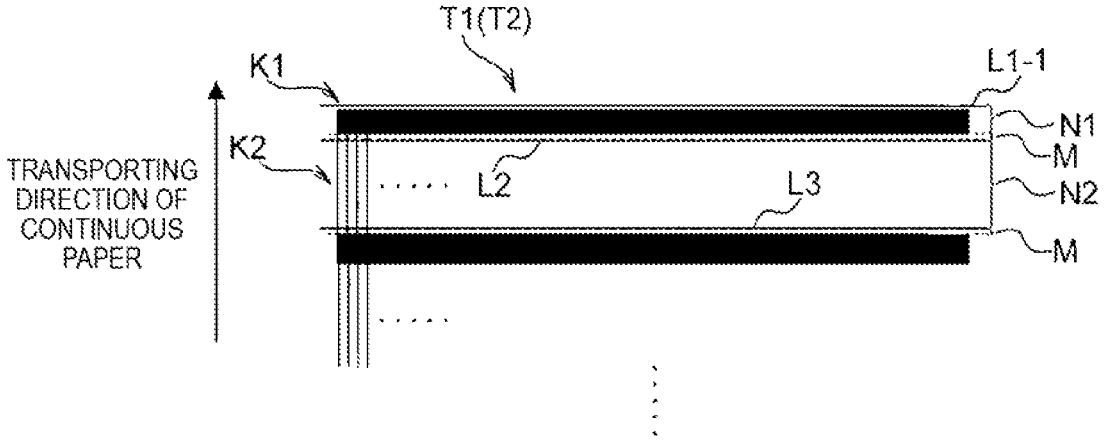
FIG. 12 is a plan view used for describing one example of the reading processing performed by the image reading unit in the state in which the continuous paper and the image reading unit related to each embodiment are not inclined to each other.

In FIG. 12, one example in the state where the image reading unit 70 and the continuous paper P are not relatively inclined in the transporting direction is illustrated.

As illustrated in FIG. 12, the length in the transporting direction of the standard image K1 related to this embodiment is a length N1. In addition, in the detection image K2 related to this embodiment, a length M in the transporting direction of each end portion of the upstream or the downstream in the transporting direction is each margin, and the part of a length N2 in the transporting direction in the gaps between each margin is a detection area used for detecting an abnormal nozzle.

Hereinafter, as one example, the case where the length N is 2.1 mm, the length M is 0.3 mm, the length N2 is 6.4 mm, and the length of the reading line in the transporting direction by the image reading unit 70 is 0.1 mm will be described. As illustrated in FIG. 12, in the case where the image reading unit 70 and the continuous paper P are not relatively inclined in the transporting direction, the CPU 80 detects that the standard image K1 has a black pixel at the both end portions of the read image in the intersecting direction at the timing when the standard image K1 is read for the first time by the image reading unit 70. In addition, in FIG. 12, the position of the reading line at this timing is illustrated as a line L1-1. Therefore, in this case, at the timing, the step 300 is positive, the step 304 is determined as negative, and the value of the variable cnt is 0 (zero).

In addition, the CPU 80 detects an abnormal nozzle after the image for the length N1 and the length M are read by the image reading unit 70. Specifically, the CPU 80 starts reading the detection image K2 by the image reading unit 70 after transporting the continuous paper P for the remained length N1 and the length M (in the above example, for 2.3 mm) after the both end portions of the standard image K1 in the intersecting direction are read by the image reading unit 70. In addition, while the continuous paper P is transferred for remained length N1 and the length M, the reading by the image reading unit 70 may be performed or not. In addition, in FIG. 12, the position of the reading line at the timing when the reading of the detection image K2 starts is illustrated as a line L2.

Figure 13:
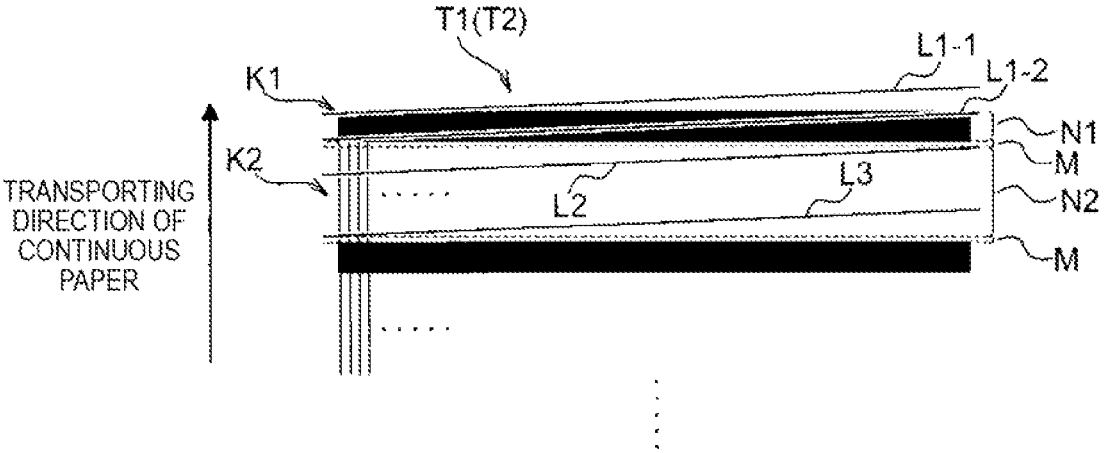
FIG. 13 is a plan view used for describing one example of the reading processing performed by the image reading unit in the state in which the continuous paper and the image reading unit related to each embodiment are inclined to each other.

Meanwhile, in FIG. 13, one example in the state where the image reading unit 70 and the continuous paper P are relatively inclined in the transporting direction is illustrated. In addition, here, as one example, the case where, only for the deviation of 2 mm in the transporting direction (the amount of deviation illustrated in FIG. 11 is 2 mm) between the position of the one end portion of the standard image K1 of the reading line and the position of the other end portion corresponding thereto, the image reading unit 70 and the continuous paper P are relatively inclined will be described.

In this case, as illustrated in FIG. 13, after the left end portion of the standard image K1 in FIG. 13 is read by the image reading unit 70, the right end portion of the standard image K1 in FIG. 13 is read by reading by the 19th image reading unit 70. Therefore, the value of the variable cnt is 19 at the timing when the step 306 is determined as positive, and this value indicates the difference between the reading timing of the left end portion and that of the right end portion by the image reading unit 70. In addition, in FIG. 13, the position of the reading line at the timing where the left end portion is read is illustrated as the line L1-1, and the position of the reading line at the timing when the right end portion is read is illustrated as a line L1-2.

In addition, the CPU 80 starts reading the detection image K2 after transporting the continuous paper P for the remained length N1 and the length M (in the above example, for 2.3 mm) after the right end portion of the standard image K1 is read by the image reading unit 70. In addition, in FIG. 13, the position of the reading line at the timing when the reading of the detection image K2 starts is illustrated as the line L2.

In a step 310 of FIG. 10, the CPU 80 transports the continuous paper P for the remaining length N1 and the length M until the position of the reading line is the position of the line 2 as described above, and proceeds to the processing of a step 312.

In the step 312, the CPU 80 reads the detection images K2 for one line by the image reading unit 70 and acquires a brightness information output from the image reading unit 70. In addition, the CPU 80 acquires the light intensity for each position of the nozzles 52 in the detection target nozzle by performing the second interpolation with regard to the light intensity indicated by the acquired brightness information.

The processing of the main step 312 will be described with reference to FIG. 14. A vertical axis of FIG. 14 indicates the light intensity indicated by the brightness information output from the image reading unit 70. In addition, in this embodiment, as one example, the light intensity has a separate value for each notch from the light intensity 0 to 255 (8 bit configuration). The greater the value is, the closer the color comes to white, and the smaller the value is, the closer the color comes to black. In addition, the vertical axis of FIG. 14 indicates the position of each nozzle 52 in the intersecting direction in the detection target nozzle, and a rectangular point plotted in FIG. 14 indicates the light intensity of each pixel output from the image reading unit 70.

Figure 14:
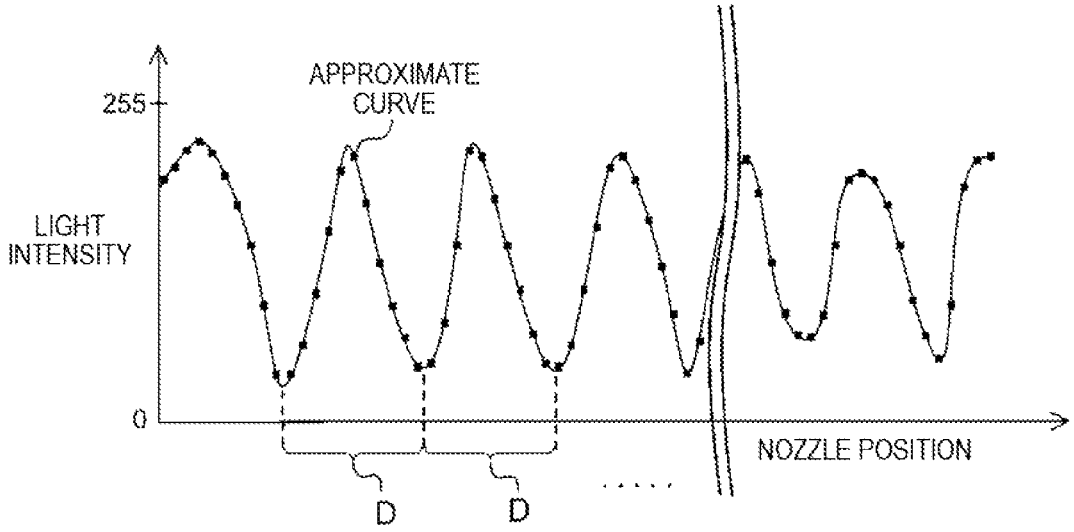
FIG. 14 is a graph that illustrates one example of the light intensity for each position of the nozzle related to each embodiment.

In the step 312, the CPU 80 obtains an approximate curve illustrated in FIG. 14 and derives the light intensity corresponding to the position of each nozzle 52 by performing second interpolation with regard to the light intensity of each pixel indicated by the brightness information output from the image reading unit 70.

In a next step 314, the CPU 80 adds the light intensity added together by the processing of the main step 314 of the previous time in the repeated processing from a step 312 to a step 316 to the light intensity derived by the previous step 312. In addition, in the case where the processing of the main step 314 is performed in the first time in the repeated processing from the step 312 to the step 316, the CPU 80 adds 0 (zero) and the light intensity derived by the previous step 312.

In the step 316, the CPU 80 determines whether or not the timing when the reading of the detection image K2 is terminated has been reached. The CPU 80 returns to the processing of the step 312 in the case where the determination is negative, and proceeds to the processing of a step 318 in the case where the determination is positive. In addition, in this embodiment, as the timing, a timing when the reading by the image reading unit 70 only for X times obtained by a following equation (1) is completed is applied by using a number of times of reading C and the variable cnt by the image reading unit 70 required for the reading of the line for the length N2.

(Equation 1)

$$X=C-\text{cnt} \quad (1)$$

Therefore, in the case illustrated in FIG. 12, reading is performed 64 times (=6.4/0.1) by the image reading unit 70 from the position of the line L2 to the position of the line L3. In the case illustrated in FIG. 13, reading is performed 45 times (=64−19) by the image reading unit 70 from the position of the line L2 to the position of the line L3.

In the step 318, the CPU 80 averages the light intensity added together by the processing from the step 312 to the step 316 being repeatedly performed by dividing the light intensity by the number of times of reading X of the detection image K2 by the image reading unit 70.

In a next step 320, the CPU 80 sets a threshold Y used in a step 322 to be described so that the greater the difference is between the timings when the one end portion of the standard image K1 by the image reading unit 70 in the intersecting direction and the other portion, the less likely that the state is determined as abnormal. Specifically, the CPU 80 sets the threshold Y as a great value as the value of the variable cnt is great.

In a next step 322, the CPU 80 converts the space (a space D illustrated in FIG. 14) between the convex peak values on the lower side the light intensity averaged by the processing of the step 320 into a space for each straight line adjacent to the detection images K2 based on the resolution of the image reading unit 70. In addition, the CPU 80 derives the difference between the converted space and the space between the nozzles 52 corresponding to the actual device, and determines that the nozzle 52 in a corresponding position is an abnormal nozzle in the case where the difference is equal to or more than the threshold Y set by the processing of the step 320. Moreover, the CPU 80 specifies a nozzle number corresponding to the abnormal nozzle based on the position of the nozzle 52 determined to be an abnormal nozzle and the nozzle number acquired by the processing of the step 200, and stores the nozzle number in the storing unit 86.

In addition, in the step 322, the CPU 80 may perform the determination processing of the abnormal nozzle, not regarding a peak value of which the light intensity is equal to or more than a predetermined threshold among the convex peak values on the lower side, as a peak value. As the threshold in this case, a threshold set by the user through the operation displaying unit 90 may be applied, and, for example, the average of the maximum value and the minimum value of the light intensity averaged by the processing of the step 318 may be applied.

In addition, in the step 322, the CPU 80 performs determination of an abnormal nozzle based on the space for each straight line adjacent to the detection images K2, but the determination is not limited thereto. For example, the CPU 80 may perform determination of an abnormal nozzle based on the position of the convex peak value on the lower side in the intersecting direction, of which the standard is the position of the nozzle number in the intersecting direction acquired, by the processing of the step 200.

In a next step 324, the CPU 80 determines whether the processing from the step 300 to the step 322 is completed in both of the standard image K1 and the detection image K2. The CPU 80 returns to the processing of the step 300 in the case where this determination is negative, and proceeds to the processing of a step 326 in the case where the determination is positive.

In the step 326, the CPU 80 determines whether an abnormal nozzle is detected by determining whether the nozzle number of the abnormal nozzle is stored in the storing unit 86. The CPU 80 proceeds to the processing of the step 328 in the case where the determination is positive.

In the step 328, the CPU 80 reads the nozzle number of the abnormal nozzle from the storing unit 86 and informs regarding the nozzle number by displaying the nozzle number on the operation displaying unit 90. In addition, in the step 328, the CPU 80 may perform, for example, maintenance processing such as cleaning processing with regard to the nozzle number. Moreover, in the step 328, the CPU 80 may set a parameter of the nozzle 52 so that the size of the ink drop discharged from the nozzle 52 adjacent to the nozzle with the nozzle number is greater than the common case.

Meanwhile, the CPU 80 terminates the abnormal nozzle determination processing routine and program without performing the processing of the step 328 in the case where the determination in the step 326 is negative.

As illustrated above, in this embodiment, in the case where the width of the image forming area G in the intersecting direction is greater than the width of the test images T in the intersecting direction at the registration position side, the reading scope is determined so that the reading scope in the intersecting direction is maximum by the image reading unit 70 of the test image T2 formed at the other end portion side opposite to the registration position of the continuous paper P in the intersecting direction.

In contrary, for example, a case can be considered where the entire test image T1 is read by the image reading unit 70A and the scope of the test image T2 in the intersecting direction that does not overlap with the test image T1 in the transporting direction is read by the image reading unit 70B. In this case, according to the width of the image forming area G in the intersecting direction, there is a case where the image read by the image reading unit 70B is, for example, an image formed by the one or two nozzles 52. In this case, if an abnormal nozzle is included in the nozzles 52, the abnormal nozzle is not accurately detected. Therefore, in this embodiment, compared to this case, since the reading scope in the intersecting direction by the image reading unit 70B is wide, the reading element in an abnormal state is accurately detected.

In addition, according to the pixel number of the reading scope by the image reading unit 70B, there is a case where the processing of the second interpolation of the step 312 cannot be performed. In this embodiment, the width W4 is a width read to be equal to or more than the pixel number (in this embodiment, 5 pixels) predetermined by the image reading unit 70, and the determination processing of an abnormal nozzle is performed from the convex peak value on the lower side based on the approximate curve obtained by the second interpolation, and thus the recording element in an abnormal state is accurately detected.

In addition, in this embodiment, detection of an abnormal nozzle is performed by using the same test image information even when the width of the image forming area G in the intersecting direction changes. Therefore, compared to the case where the test image information is stored for each width of the image forming area G (that is, for each size of the continuous paper P) in the intersecting direction, the used amount of the means for storing (in this embodiment, the storing unit 86) decreases.

Moreover, in this embodiment, as the relative inclination of the image reading unit 70 and the continuous paper P is smaller in the transporting direction, the reading of the detection image K2 by the image reading unit 70 is more frequent. Thereby, compared to the case where the reading of the detection images K2 by the image reading unit 70 is performed for the number of times obtained by assuming the amount of inclination and setting the value as the fixed value (for example, in this embodiment, 45 times), an abnormal nozzle is accurately detected. In addition, since the reading of the detection images K2 is performed by the image reading unit 70 for plural times, the influence by abnormality such as unexpected and sporadic ink drop discharge abnormality by the nozzle 52 can be suppressed.

(Second Embodiment)

In the first embodiment, the case where the registration position of the ink jet recording device 10 is the side registration is described. In contrast, in a second embodiment, the case where the registration position of the ink jet recording device 10 is the center unit of the continuous paper P in the intersecting direction will be described. Moreover, hereinafter, as in this embodiment, the registration position being the center part of the continuous paper P in the intersecting direction is referred to as "center registration". In addition, since the configuration of an ink jet recording device 10 related to this embodiment is the same as in the ink jet recording device 10 related to the first embodiment (refer to FIGS. 1 to 4), the description thereof will be omitted here.

First, with reference to FIG. 15, the test image of the ink jet recording device 10 that relates to this embodiment will be described. Meanwhile, also in this embodiment, the case where entire nozzles 52 at the position corresponding to the width of an image forming area G in the intersecting direction determined according to the size of a continuous paper P is a detection target nozzle will be described.

Figure 15:
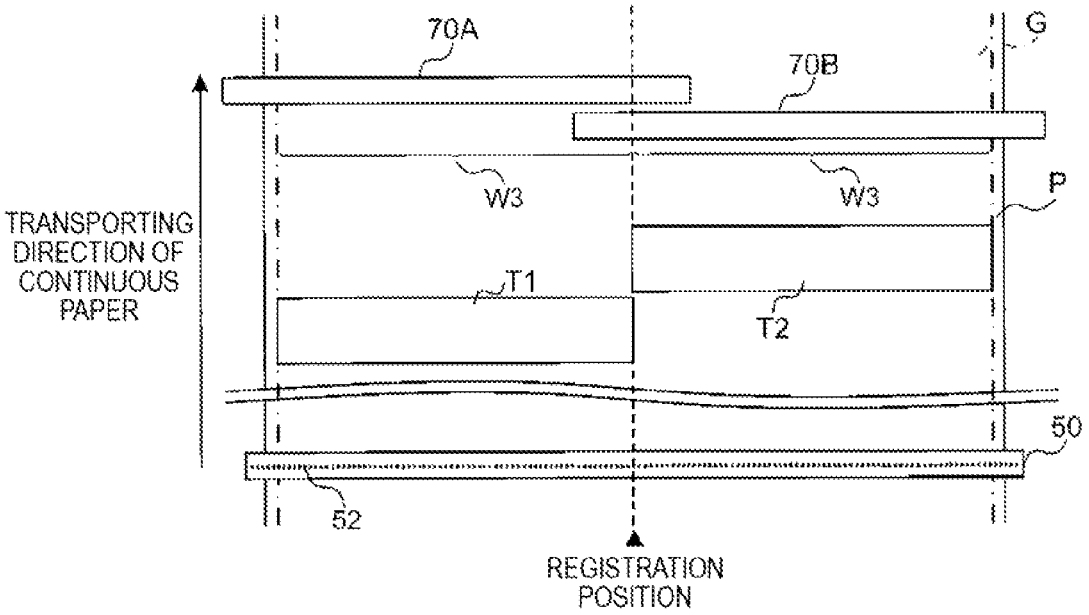
FIG. 15 is a plan view used for describing one example of the determination processing of the reading scope performed by the image reading unit related to a second embodiment.

As illustrated in FIG. 15, test images T1 and T2 related to this embodiment are formed in the order of the test image T1 to the test image T2 from the upstream of a transporting direction. In addition, the test images T1 and T2 related to this embodiment are set as the images with the same size and shape. In addition, hereinafter, in the case where there is no need to distinguish between the test images T1 and T2, the number at the end of the symbol is omitted. Furthermore, as illustrated in FIG. 15, test images T related to this embodiment are formed so that adjacent end portions are not overlapped in the transporting direction but continues along an intersecting direction. Moreover, in the test images T related to this embodiment, the position of the adjacent portions in the intersecting direction is the same position as the registration position (the center part of the continuous paper P). That is, the test images T1 and T2 related to this embodiment are also formed at the position on the continuous paper P in which the area of the width predetermined from the end portion of the reading area in the intersecting direction of each of image reading units 70A and 70B is not included.

Figure 16:
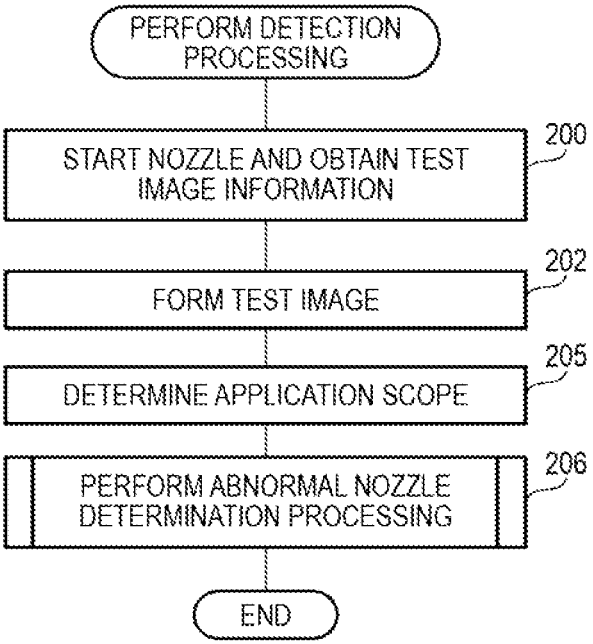
FIG. 16 is a flowchart that illustrates the flow of the processing of the detection processing program related to the second embodiment.

Next, with reference to FIG. 16, the operation of the ink jet recording device 10 related to this embodiment will be described. In addition, FIG. 16 is a flowchart illustrating the flow of the processing of the detection processing program executed by the CPU 80 when an instruction input that instructs regarding the execution start through the operation displaying unit 90 by the user is input. In addition, the detection processing program is installed in the ROM 82 in advance. Moreover, the same step number as in FIG. 7 is attached to a step in Fig, 16 in which the same processing is performed as in FIG. 7, and the description thereof is omitted.

In a step 205 in FIG. 16, the CPU 80 respectively determines the scopes of reading by the image reading units 70A and 70B as the application scopes of the reading data of the test images T1 and T2 by the image reading units 70A and 70B. Specifically, the CPU 80 determines the reading scope by the image reading unit 70A as an area from the predetermined position in a reading repetition area (in this embodiment, the registration position) in the intersecting direction to the position of one end portion of the image forming area G in the intersecting direction. In addition, the CPU 80 determines the reading scope by the image reading unit 70B as an area from the predetermined position to the position of the other end portion of the image forming area G in the intersecting direction. Therefore, in this embodiment, the test image T1 is read by the image reading unit 70A, and the test image T2 is read by the image reading unit 70B.

Each embodiment is described in the above. However, the technical scope of the present invention is not limited to the scope of each embodiment described herein. Various changes or improvements can be added to each embodiment without departing from the gist of the invention, and an embodiment to which the changes or improvements are added is also included in the technical scope of the present invention.

In addition, each embodiment does not limit the present invention pertaining to the claims, and the entire combination of characteristics described in each embodiment is not necessarily essential to the means for solving the problem. In each embodiment described above, various steps of the invention are included, and the various inventions are extracted by the combination of plural disclosed components. Even if the several components are removed from the entire components illustrated in each embodiment, as long as the effect thereof can be obtained, the configuration in which the several components are removed is extracted as the invention.

For example, in each embodiment, the case where the test images T in the determined application scope is read by the image reading unit 70 is described. However, the present invention is not limited thereto. For example, after the entire test images T in the reading scope of the image reading unit 70 are read, the determination processing of an abnormal nozzle with regard to the reading data obtained by the reading may be performed in the determined application scope.

Figure 17:
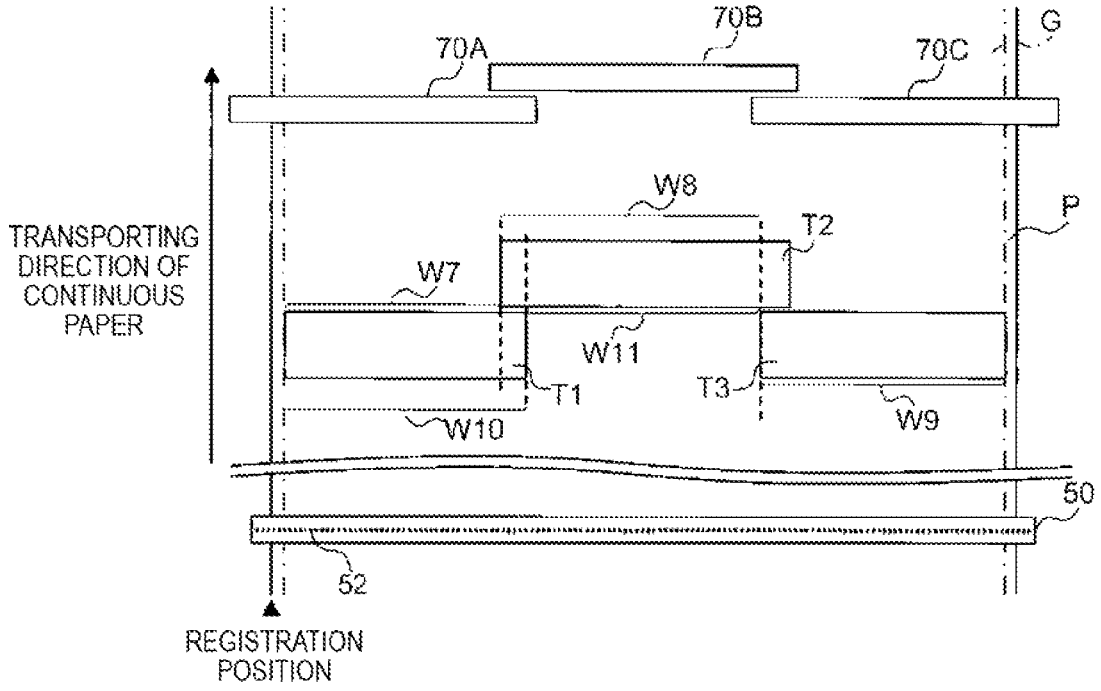
FIG. 17 is a plan view used for describing a modification example of the determination processing of the reading scope performed by the image reading unit.

In addition, in each embodiment, the case where two image reading units 70 are provided is described. However, the present invention is not limited thereto. For example, three image reading units 70 may be provided. In FIG. 17, one example in a state where three image reading units 70 are provided in the first embodiment is illustrated, and in FIG. 18, one example in a state where three image reading units 70 are provided in the second embodiment is illustrated.

As illustrated in FIG. 17, also in the case where three image reading units 70 are provided, the CPU 80 determines the reading scope so that the reading scope of a test image T3 is maximum by an image reading unit 70C positioned at the other end portion side opposite to the registration position in the intersecting direction in the continuous paper P in the step 204 of the detection processing program.

Specifically, as illustrated in FIG. 17, in the case where the registration is the side registration regarding the position, the CPU 80 determines a width W7 from the end portion at the registration position side of the test image T1 in the intersecting direction to the end portion at the registration position side of the test image T2 in the intersecting direction as the reading scope by the image reading unit 70A. Specifically, the CPU 80 determines a width W8 from the end portion at the registration position side of the test image T2 in the intersecting direction to the end portion at the registration position side of the test image T3 in the intersecting direction as the reading scope by the image reading unit 70B. In addition, the CPU 80 determines that a width W9 of the test image T3 in the intersecting direction is the reading scope by the image reading unit 70C.

Moreover, in this embodiment, the CPU 80 may determine a width W10 of the test image T1 in the intersecting direction as the reading scope by the image reading unit 70A. In addition, in this embodiment, the CPU 80 may determine that a width W11 in the intersecting direction in the scope not overlapping with the test image T1 and the test image T3 in the transporting direction of the test image T2 is the reading scope by the image reading unit 70B.

Figure 18:
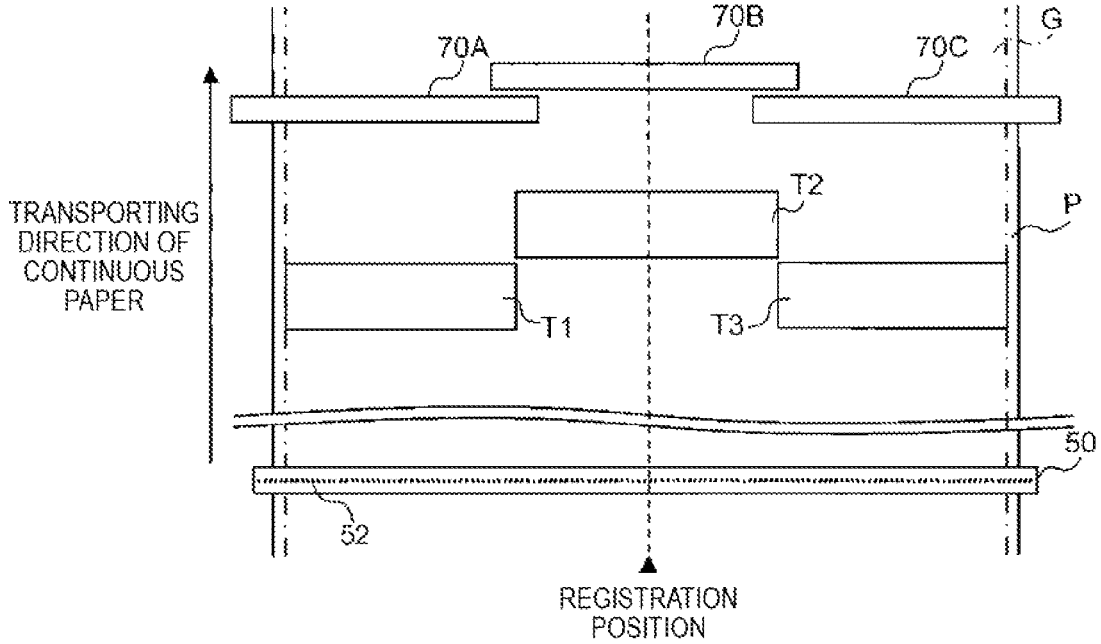
FIG. 18 is a plan view used for describing the modification example of the determination processing of the reading scope performed by the image reading unit.

Meanwhile, as illustrated in FIG. 18, in the case where the registration is the center registration regarding the position, the CPU 80 determines the width of the test image T1 in the intersecting direction as the reading scope by the image reading unit 70A, and the width of the test image T2 in the intersecting direction as the reading scope by the image reading unit 70B. Moreover, the CPU 80 determines that the width of the test image T3 in the intersecting direction is the reading scope by the image reading unit 70C.

Figure 19:
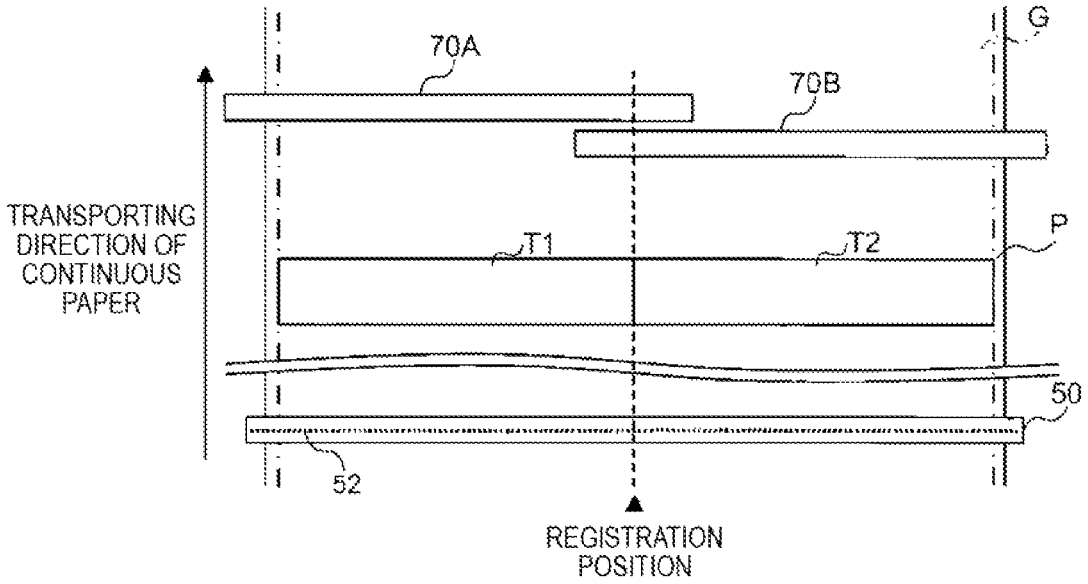
FIG. 19 is a plan view used for describing the modification example of the determination processing of the reading scope performed by the image reading unit.

In addition, in the second embodiment, the case where test images T1 and T2 are formed in the different positions in the transporting direction is described. However, the present invention is not limited thereto. For example, as illustrated in FIG. 19, the test images T1 and T2 may be formed at the same position as the transporting direction.

In addition, in each embodiment, the case where the test images T includes a standard image K1 and a detection image K2 is described. However, the present invention is not limited thereto. For example, in the test images T, the standard image K1 may not be included but only the detection image K2 may be included. Moreover, in this case, for example, as the image reading unit 70, an area sensor may be applied instead of a line sensor.

Figure 20:
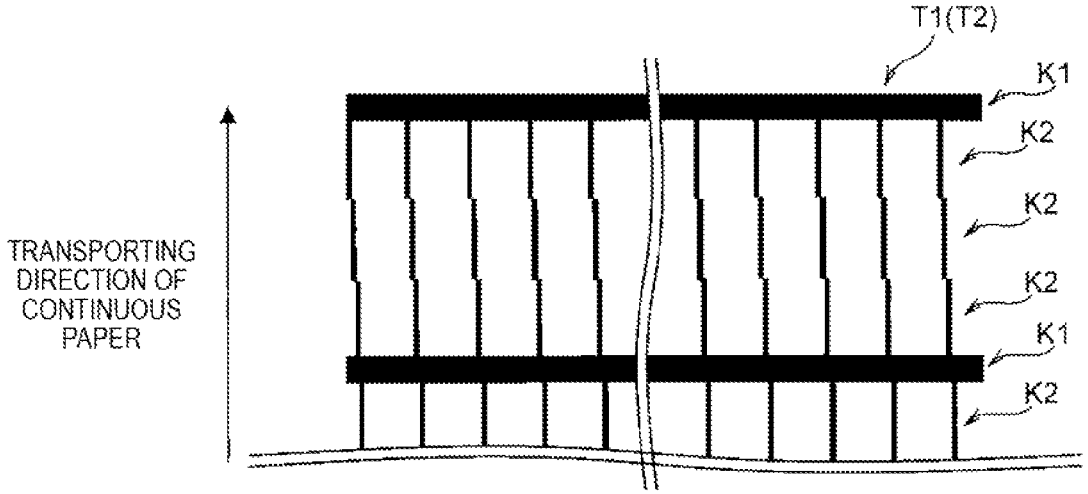
FIG. 20 is a plan view used for describing a modification example of the standard image and the detection image.

In addition, in each embodiment, the case where the standard image K1 and the detection image K2 are alternately formed is described. However, the present invention is not limited thereto. For example, the standard image K1 may be formed only once at the upstream of the transporting direction of each detection image K2. In addition, for example, as illustrated in FIG. 20, the standard image K1 and plural (in an example illustrated in FIG. 20, three) detection images K2 may be alternately formed.

Figure 21:
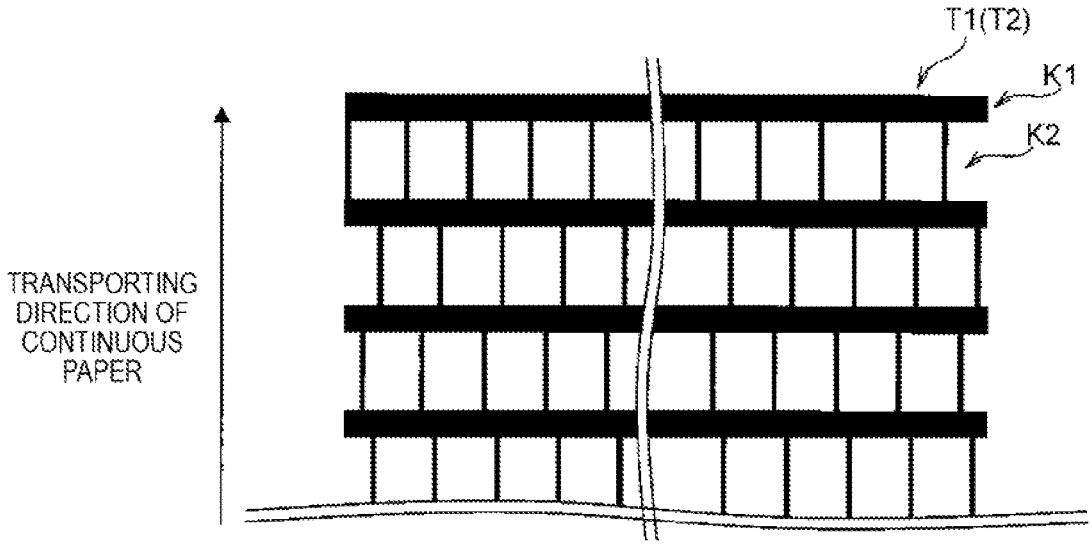
FIG. 21 is a plan view used for describing the modification example of the standard image and the detection image.

In addition, in each embodiment, the case where each detection image K2 is formed step-wise is described. However, the present invention is not limited thereto. For example, as illustrated in FIG. 21, each detection image K2 may be formed in a zigzag-check shape.

Figure 22:
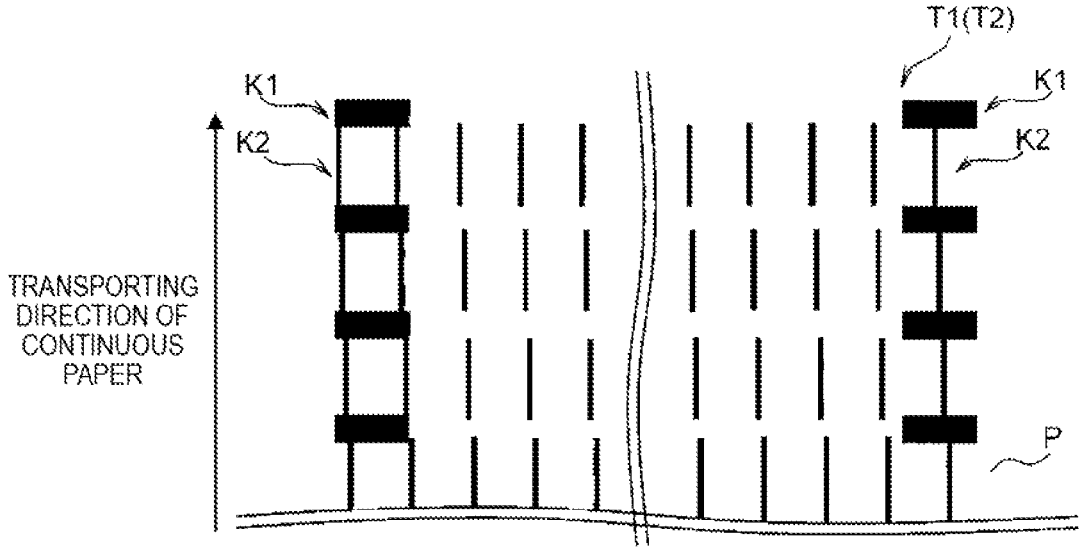
FIG. 22 is a plan view used for describing e modification example g of the standard image and the detection image.

In addition, in each embodiment, the case where the standard image K1 is formed by the entire detection target nozzles is described. However, the present invention is not limited thereto. For example, as illustrated in FIG. 22, of the detection target nozzles, the standard image K1 may be formed by only plural nozzles 52 continuously arranged at the both end portions in the intersecting direction.

In addition, in each embodiment, the case where the greater the difference between the timings when one end portion and the other portion of the standard image K1 in the intersecting direction are read by the image reading unit 70, the greater a threshold Y is set to perform the detection of an abnormal nozzle is described. However, the present invention is not limited thereto. For example, the threshold Y may not be changed, but a space D corresponding to the detection image K2 read by the image reading unit 70 may be changed to be decreased as the difference between the timings is greater to perform the detection of an abnormal nozzle. In addition, for example, both the threshold Y and the space D may be adjusted corresponding to the difference between the timings.

In addition, in each embodiment, the case where the image reading unit 70 and the continuous paper P are relatively inclined in the transporting direction, and the both end portions of the standard image K1 in the intersecting direction are read by one reading by the image reading unit 70 is described. However, the present invention is not limited thereto. For example, in the state where the image reading unit 70 and the continuous paper P are relatively inclined in the transporting direction, the both end portions of the detection images K2 in the intersecting direction may not be read by one reading by the image reading unit 70. In this case, for example, the one end portion of the standard image K1 in the intersecting direction is first read by the image reading unit 70. Thereafter, by detecting that a black pixel continues in the intersecting direction of an image read by the image reading unit 70, it is detected that the image is the standard image K1. Moreover, thereafter, the other end portion of the standard image K1 in the intersecting direction is read by the image reading unit 70. In addition, based on the difference between the reading timings of the one end portion and the other portion, the number of times of reading C of the detection image K2 by the image reading unit 70 and the threshold Y used for detecting an abnormal nozzle are set as in each embodiment, and an embodiment where the abnormal nozzle is detected is illustrated.

In addition, it is not particularly mentioned in each embodiment, but, before specifying the nozzle number of the abnormal nozzle, whether the abnormal nozzle exists may be determined. In this case, for example, between the step 318 and the step 320 of the abnormal nozzle determination processing routine and program, the embodiment where the determination processing is performed that determines whether the abnormal nozzle exists is illustrated. In addition, as the determination processing of this embodiment, in the case where the number of the convex peak value on the lower side and the number of the nozzles 52 used for forming the detection image K2 corresponding thereto are different, the embodiment where it is determined that the abnormal nozzle exists is illustrated. With regard to discharge abnormality, by this determination, whether the abnormal nozzle exists is determined.

In addition, it is not particularly mentioned in each embodiment, but, based on the difference of the timings of reading the one end portion and the other end portion of the standard image K1 in the intersecting direction, the installing position (inclination angle corresponding to the transporting direction) of the image reading unit 70 may be corrected.

In addition, in each embodiment, the case where one long head is applied as the recording head 50 is described. However, the present invention is not limited thereto. For example, as the recording head 50, plural short heads arranged along in the intersecting direction may be applied.

In addition, in each embodiment, the case where the present invention is applied to the ink jet recording device is described. However, the present invention is not limited thereto. For example, the present invention may be applied to other image forming devices such as a light emitting diode (LED) printer.

In addition, in each embodiment, the case where the continuous paper P is applied as a recording medium is described. However, the present invention is not limited thereto. For example, as a recording medium, a cut paper in a regular form such as A4 or A3 may be applied. In addition, the material of the recording medium is not limited to paper, and a recording medium with other materials may be used.

In addition, in each embodiment, the case where various programs are installed in the ROM 82 in advance is described. However, the present invention is not limited thereto. For example, the various programs may be provided contained in a storing medium such as a compact disk read only memory (CD-ROM) or provided through the network.

Moreover, in each embodiment, the case where the detection processing is realized by executing a program by a software configuration by using a computer is described. However, the present invention is not limited thereto. For example, the detection processing may be realized by a hardware configuration, or the combination of a hardware configuration and a software configuration.

Additionally, the configuration of the ink jet recording device 10 (refer to FIGS. 1 to 4) in each embodiment is one example, and it is needless to say that the unnecessary part thereof may be removed or a new part may be added without departing from the gist of the invention.

In addition, the flow of the processing of various programs (refer to FIGS. 7, 10, and 16) in each embodiment is also one example, and it is needless to say that the unnecessary step thereof may be removed, a new step may be added, or the processing order may be switched without departing from the gist of the invention.

What is claimed is:

1. An image forming device, comprising:

plural recording elements that are arranged along an intersecting direction that intersects with a transporting direction of a recording medium;

plural reading units each including a reading area which extends in the intersecting direction, and that read plural test images formed by driving the recording elements using the reading areas, and that are provided along the intersecting direction so that adjacent end portions of the reading areas overlap in the transporting direction, which defines as an overlapping reading area;

a forming unit forms the plural test images by driving the recording elements as a detection target in an abnormal state, in which a position of each test image is predetermined in accordance with a standard position, as a position matching of the recording medium in the intersecting direction, the position of each test image corresponds to the reading area on the recording medium, and each test image is formed so that an area having a width predetermined from an end portion of the corresponding reading area in the intersecting direction is not included;

a determining unit that determines, in advance of reading each test image by each reading unit for obtaining reading data, an application scope of the reading data applied for detecting the abnormal state so that the reading data of each test image formed by the recording elements as the detection target does not include overlapping data with respect to each recording element; and a detecting unit that detects the recording elements in the abnormal state by using the reading data obtained by each reading unit in the application scope determined by the determining unit.

2. The image forming device according to claim 1, wherein the determining unit determines the application scope (i) by determining a reading scope in each reading unit so that only one of parts of the test images recorded by the same recording element is read by the reading unit, or, (ii) after the parts of the test images recorded by the same recording element are read by at least one of the plural reading units, adjusting the reading data so that one of the parts is included in the application scope.

3. The image forming device according to claim 1, wherein the standard position is one end portion of the recording medium in the intersecting direction, the forming unit forms the plural test images on the recording medium along the intersecting direction so that adjacent end portions of the test images overlap in the transporting direction in an area corresponding to the overlapping reading area, and when a width of an image forming area of the recording medium in the intersecting direction is greater than the width of the test image in the intersecting direction formed at the one end portion, the determining unit determines a size of the test image formed at a side of the other end portion of the recording medium in the intersecting direction as the application scope of the reading data obtained by the reading unit located at the side of the other end portion.

4. The image forming device according to claim 1, wherein the standard position is a center part of the reading medium in the intersecting direction, the forming unit forms the plural test images so that the test images are not overlapped in the transporting direction and continue along the intersecting direction, and the determining unit determines a size of each test image as the application scope of the reading data obtained by the corresponding reading unit.

5. The image forming device according to claim 1, wherein the reading units sequentially reads the plural test images along the transporting direction for every line extending in the intersecting direction, the test image includes at least one standard image that is formed by driving the reading elements continuously arranged along the intersecting direction as the detection target of the abnormal state at the same timing, and has a length in the transporting direction corresponds to a length read by plural times by the reading unit, and plural detection images that are formed by driving the reading elements continuously arranged along the intersecting direction as the detection target of the abnormal state at different timings and continues to the standard image, the detecting unit detects the recording elements in the abnormal state using a detection value and a threshold in accordance with reading data of the standard image and reading data of the detection images, and the detecting unit detects the recording elements in the abnormal state by changing at least one of the detection value and the threshold so that the greater the difference of timings is between one end portion and the other end portion of the standard image in the intersecting direction read by the reading unit, the less likely the state is determined as the abnormal state.

6. The image forming device according to claim 5, wherein the forming unit forms the detection images on the recording medium by dividing the recording elements as the detection target of the abnormal state into plural recording element groups each of which has recording elements arranged by spacing for a predetermined number of recording elements in the intersecting direction, and by differentiating the timings of driving for every divided recording element group.

7. The image forming device according to claim 6, wherein the forming unit alternately forms the standard images and the detection images on the recording medium in the transporting direction.

8. The image forming device according to claim 6, wherein a length of the detection image in the transporting direction respectively formed by driving each of the plural recording element groups at different timings corresponds to the length read for plural times by the reading unit, and the detecting unit detects the reading elements in the abnormal state by reading each detection image by the reading unit by increasing the number of times of reading in response to the difference of the timings between one end portion and the other end portion of the standard image in the intersecting direction read by the reading unit being decreased.

9. The image forming device according to claim 5, wherein the forming unit forms the standard image by driving the plural recording elements continuously arranged at the position including the both end portions of the image forming area of the reading medium in the intersecting direction.

10. The image forming device according to claim 9, wherein the forming unit forms the standard image without driving the recording elements arranged at a middle part of the both end portions.

11. The image forming device according to claim 5, wherein the length of the standard image in the transporting direction is set to a length in which the one end portion and the other end portion of the standard image are read by one reading by the reading unit in the state where the reading unit and the reading medium are relatively inclined in the transporting direction by a predetermined allowable maximum angle.

12. A non-transitory computer readable medium storing a program of an image forming device which comprises (i) plural recording elements that are arranged along an intersecting direction that intersects with a transporting direction of a recording medium, and (ii) plural reading units each including a reading area which extends in the intersecting direction, and that read plural test images formed by driving the recording elements using the reading areas, and that are provided along the intersecting direction so that adjacent end portions of the reading areas overlap in the transporting direction, which defines as an overlapping reading area, wherein the program causes the image forming device to function as:

a forming unit forms the plural test images by driving the recording elements as a detection target in an abnormal state, in which a position of each test image is predetermined in accordance with a standard position, as a position matching of the recording medium in the intersecting direction, the position of each test image corresponds to the reading area on the recording medium, and each test image is formed so that an area having a width predetermined from an end portion of the corresponding reading area in the intersecting direction is not included;

a determining unit that determines, in advance of reading each test image by each reading unit for obtaining reading data, an application scope of the reading data applied for detecting the abnormal state so that the reading data of each test image formed by the recording elements as the detection target does not include overlapping data with respect to each recording element; and a detecting unit that detects the recording elements in the abnormal state by using the reading data obtained by each reading unit in the application scope determined by the determining unit.

* * * * *